US005325545A

United States Patent [19]

Hirano

[11] Patent Number: 5,325,545

[45] Date of Patent: Jul. 5, 1994

[54] ANIMAL SOCKS FOR CHILDREN

[75] Inventor: Takahiro Hirano, Sano, Japan

[73] Assignee: Hirano Seni Co., Ltd., Japan

[21] Appl. No.: 969,493

[22] Filed: Oct. 30, 1992

[30] Foreign Application Priority Data

Oct. 31, 1991 [JP] Japan ..... 3-089883[U]
May 28, 1992 [JP] Japan ..... 4-035950[U]

[51] Int. Cl.[5] ..... A41B 11/00
[52] U.S. Cl. ..... 2/239; 66/178 R
[58] Field of Search ..... 2/75, 80, 83, 240, 239, 2/409; 36/7.1 R, 9, 10; 66/178 R; 446/370, 371, 372

[56] References Cited

U.S. PATENT DOCUMENTS 3,003,154 10/1961 Litman ..... 2/239
3,017,640 1/1962 Cardwell et al. ..... 2/239
3,023,420 3/1962 Tann ..... 2/239
4,005,494 2/1977 Burn ..... 2/239
4,295,647 10/1981 Daly ..... 2/239
4,961,235 10/1990 Williger ..... 2/239
5,133,091 7/1992 del Valle Mas ..... 2/239

FOREIGN PATENT DOCUMENTS 2363292 3/1978 France ..... 2/239

*Primary Examiner*—Clifford D. Crowder
*Assistant Examiner*—Jeanette E. Chapman
*Attorney, Agent, or Firm*—Basile and Hanlon

[57] ABSTRACT

A pair of bags are provided on a front side upper portion of a sock main body of each of a pair of socks so that the bags are aligned traversely. The bags are knitted goods similar to the sock main body, and the inside of the bags is in communication with the inside of the sock main body.

4 Claims, 6 Drawing Sheets

ANIMAL SOCKS FOR CHILDREN

BACKGROUND OF THE INVENTION

1. Field of the Invention

The present invention relates to a pair of socks, and in particular, to a pair of socks simulated to a face of an animal to attract interest of infants or children.

2. Description of the Prior Art

A pair of socks are known in the art in which a face of an animal is drawn, or a piece of cloth having a shape of a face of an animal is sewed to each of the socks so that the socks are simulated to the face of the animal.

Such socks perform an inherent function as socks, and at the same time, they perform a function of attracting interest of children, and they are suitable for toys of infants or children.

However, in the prior art socks, since a face of an animal is drawn as a decorative pattern, or a piece of cloth having a shape of a face of an animal is merely sewed to the socks, they lack the feeling of a solid or three-dimensional body, and the interest of children is not so strong.

SUMMARY OF THE INVENTION

The present invention was made in view of the problems in the prior art, and it is an object of the invention to provide a pair of socks which are simulated to a face of an animal and which are capable of attracting more interest of the children.

In order to achieve the object, in one aspect of the invention, each of a pair of socks is formed by knitting integrally a sock main body for enclosing a foot and a pair of bags which are aligned traversely on an upper portion of the sock main body and which are in communication with the inside of the sock main body.

In another aspect of the invention, the pair of bags are stuffed with stuffings.

In still another aspect of the invention, an opening portion of each of the pair of bags has a rubber string to constrict a diameter thereof.

In the one aspect of the invention, since the pair of bags are aligned traversely or right and left on the front side upper portion of the sock main body, it is possible to simulate the pair of bags to ears or the like of an animal in accordance with a color and a shape.

Furthermore, since the pair of bags are knitted goods similar to the sock main body, they can be stretched or expanded relatively at will, and also, since they are bags, it is possible to stuff the inside of the bags with stuffings.

Accordingly, when the pair of bags are stuffed with circular stuffings, ears of a circular shape (for example, ears of an elephant or a mouse) can be formed, and when stuffed with elliptical stuffings, ears of the elliptical shape (for example, ears of a rabbit or a donkey) can be formed, and when stuffed with triangular stuffings, ears of a triangular shape, for example, ears of a cat or a dog) can be formed.

Furthermore, since the shape of the ears of the animal thus formed are maintained by the stuffings, the ears are three-dimensional, and since the bags move as if the actual ears of the animal swing as a person wearing the stocks walks, the interest is increased.

Moreover, although the pair of bags are in communication with the inside of the main body of each of the socks, the stuffings located in the inside of the bags will never fall off the bags when a person wears the socks.

Furthermore, in the third aspect of the invention, since the rubber strings attached to the inside of the bags constrict the opening portions of the pair of bags, it is suitable to form the ears having wider end portions than base portions of the ears. If circular stuffings are stuffed in the inside of the ears, ears having a circular shape will be formed easily.

DESCRIPTION OF THE PREFERRED EMBODIMENTS

Figure 1:
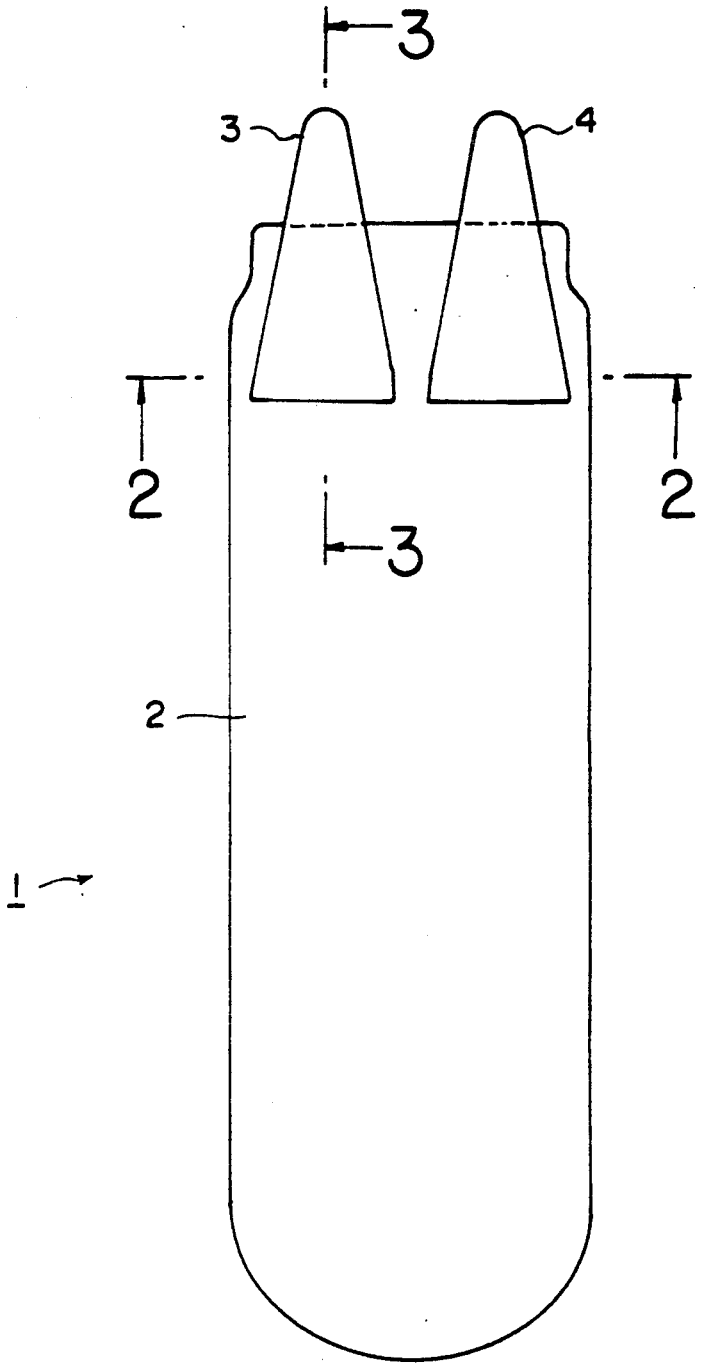
FIG. 1 is a front view of one of a pair of socks in a first embodiment of the present invention.
Figure 2:
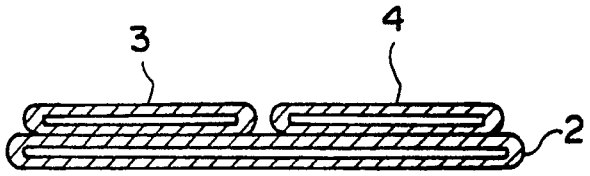
FIG. 2 is a cross sectional view taken along the line 2—2 in FIG. 1.
Figure 3:
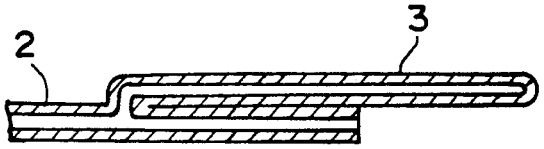
FIG. 3 is a cross sectional view taken along the line 3—3 in FIG. 1.

With reference to FIGS. 1 to 3, one of a pair of socks 1 is composed of a sock main body 2, and a pair of bags 3 and 4 aligned traversely on a front side upper portion of the sock main body 2. The sock main body 2 has an equivalent shape to that of a conventional sock, and therefore, when the sock main body 2 is put on a foot, the sock main body 2 performs an inherent function of covering the foot.

On the other hand, each of the pair of bags 3 and 4 is formed in a flat bag shape having a width narrowed gradually towards a tip end from a base portion at which the bag is connected to the sock main body 2, and the inside of the bag is in communication with only the inside of the sock main body 2.

The sock main body 2 as well as the bags 3 and 4 are knitted goods, and by knitting the bags 3 and 4 successibly at the time of knitting the sock main body 2, or by attaching separately knitted bags 3 and 4 to the sock main body 2, the bags 3 and 4 and the sock main body 2 are formed integrally or unitary as knitted goods.

Figure 4:
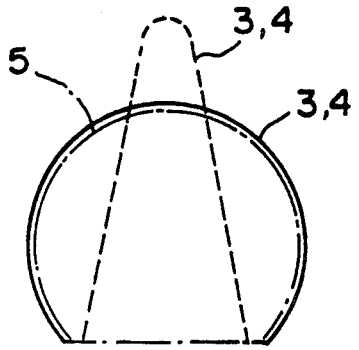
FIG. 4 is a cross sectional view of a bag portion stuffed with circular stuffing.

Since the bags 3 and 4 are knitted goods, they can be stretched relatively freely to change the shape, and thus, for example, as shown in FIG. 4, when circular stuffing 5 is stuffed in the inside of the bag 3 or 4, the bag 3 or 4 becomes circular to match the shape of the stuffing 5.

As a result, since the circular bags 3 and 4 are aligned on the front side upper portion of the sock 1, circular ears of an animal are formed, for example, when the bags 3 and 4 are turned downwardly, ears of an elephant will be shaped, and when the bags 3 and 4 are turned upwardly, ears of a mouse will be shaped.

In this respect, when it is desired to shape the circular ears as shown in FIG. 4, an original shape of the 3 or 4 having the same width continuously extending from its base to near the tip end will be suitable to form a finer circular shape, instead of the original shape of the 3 or 4 having the width which is narrowed towards the tip end from the base portion.

Figure 5:
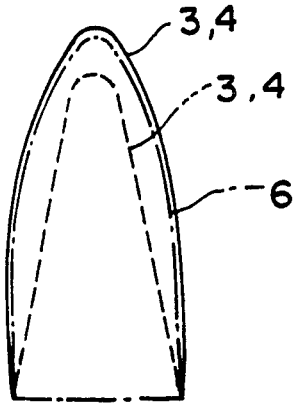
FIG. 5 is a cross sectional view of a bag portion stuffed with elliptic stuffing.
Figure 6:
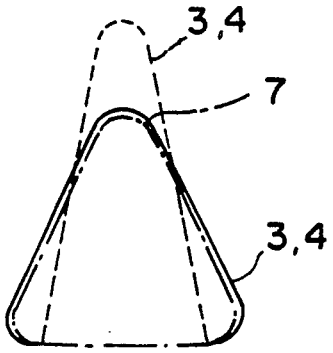
FIG. 6 is a cross sectional view of a bag portion stuffed with triangular stuffing.

Furthermore, as shown in FIG. 5, when elongate elliptic stuffings are stuffed in the inside of the bags 3 and 4, ears of an animal having an elongate shape, for example, ears of a rabbit, or ears of a donkey will be formed by the bags 3 and 4. Furthermore, as shown in FIG. 6, when triangular stuffings are stuffed in the bags 3 and 4, ears of an animal having a triangular shape, for example, ears of a cat, or ears of a dog can be formed.

Accordingly, in the sock 1 in this embodiment, since the bags 3 and 4 are integral with the sock main body 2 as knitted goods, ear of various shapes can be formed by only changing the shape of the stuffings which are stuffed into the inside of the bags 3 and 4.

Furthermore, if the color of the stuffings 5 is the same as that of the yarn used in knitting the bags 3 and 4, there will be no particular inconvenience even when the stuffings 5 are seen from the outside through the bags 3 and 4.

Moreover, in the case of the ears formed by the bags 3 and 4, since the ears mentioned above differ from ears formed by applique or the like having substantially no thickness, the above-mentioned ears are three-dimensional, and they move as if the actual ears swing as a person wearing the socks walks. Accordingly, an advantage is offered in that the interest for the socks is increased.

Since the bags 3 and 4 are in communication with the inside of the sock main body 2, the stuffings 5 to 7 stuffed into the inside of the bags 3 and 4 will never fall off when the sock 1 is worn by a person.

Furthermore, since the bags 3 and 4 may be stuffed with other materials than the stuffings 5 to 7 mentioned above, for example, when coins are stuffed into the bags 3 and 4 to form circular ears, the sock 2 will be utilized as a purse or pocket.

Furthermore, in addition to the formed ears as mentioned above, when a face of an animal is formed by drawing a pattern on the sock main body 2 with yarn of a different color, or by sewing a piece of cloth or button, or by forming protrudings and recesses at the time of knitting the sock main body 2, the interest will be further increased. Moreover, if a pattern representing a hole of the ear is drawn on the surface of each of the bags 3 and 4, the bags 3 and 4 will be more look like the ears.

Figure 7:
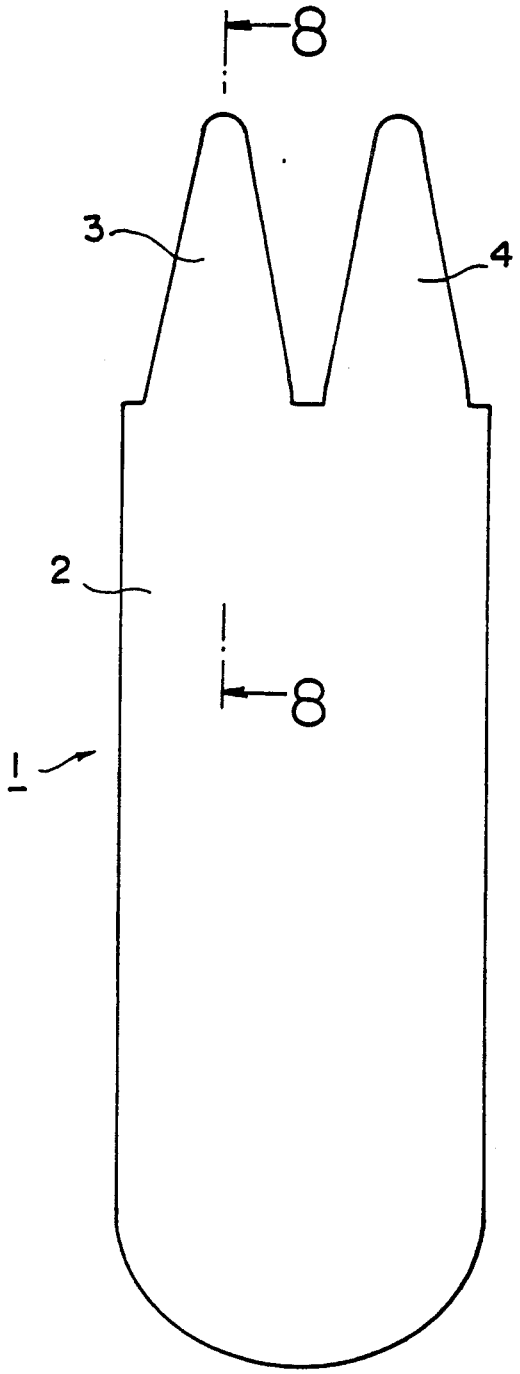
FIG. 7 is a front view of one of a pair of socks in a second embodiment of the present invention.
Figure 8:
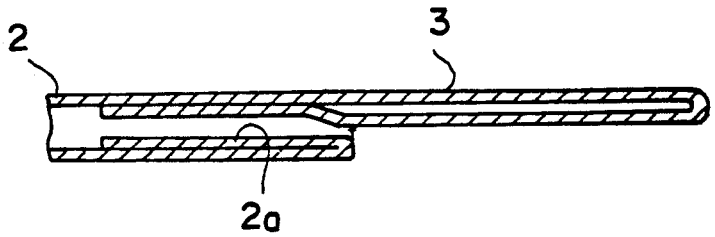
FIG. 8 is a cross sectional view taken along the line 8—8 in FIG. 7.

FIGS. 7 and 8 illustrate a second embodiment of the present invention.

In this embodiment, an upper portion 2*a* of a sock main body 2 is folded to the inside so that bags 3 and 4 are formed to extend upwardly from an upper end of the sock main body 2.

Figure 9:
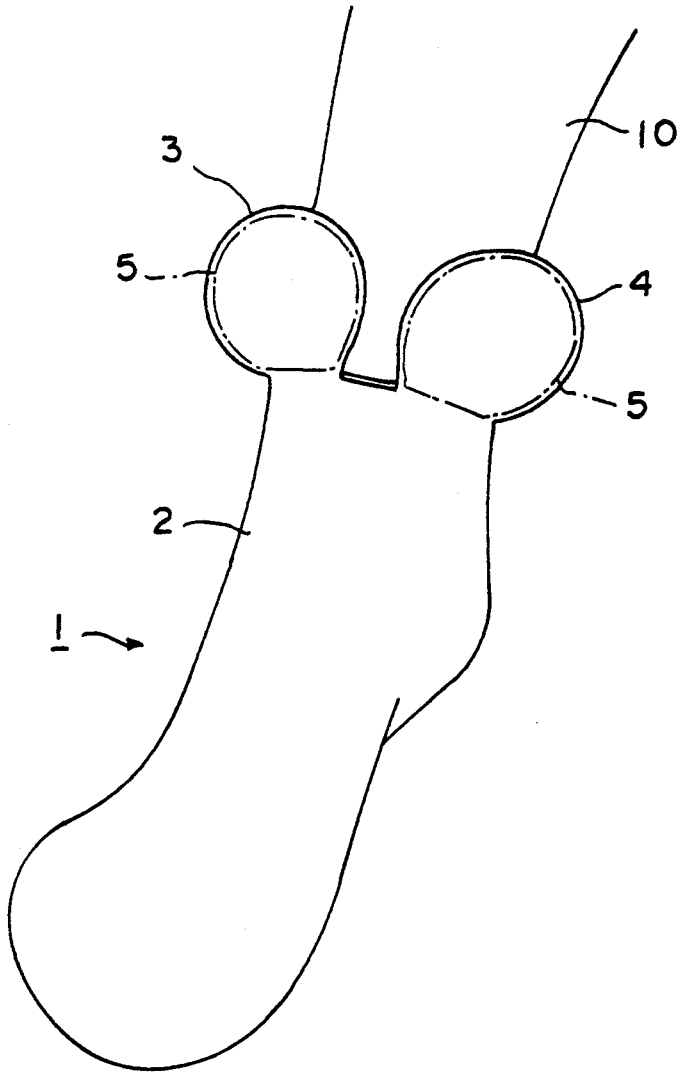
FIG. 9 is a perspective view of one of a pair of socks worn by a person.

In such a structure, when a sock 1 is put on a foot 10, as shown in FIG. 9, the ears formed by the bags 3 and 4 are aligned not on the front face but on the upper end of the sock 1. As a result, the three-dimensional appearance is further enhanced, and the interest is increased.

Furthermore, when the upper portion 2*a* which is folded to the inside of the sock main body 2 is sewed to the sock main body 2 after stuffings 5 are stuffed into the bags 3 and 4, there is an advantage in that the stuffings 5 are prevented from falling off. However, in this sewing of the upper portion 2*a* to the sock main body 2, it is necessary to pay attention that the expansion of the opening of the sock main body 2 is not disturbed.

In the first and second embodiments, it is described as to the case in which the pair of bags 3 and 4 are formed so that they are aligned traversely at the front side upper portion of the sock main body 2, however, the bags 3 and 4 may be formed at left and right lateral sides of the sock main body 2, because the bags 3 and 4 will look like ears if only the pair of bags 3 and 4 are aligned at left and right on the upper portion of the sock main body 2.

Figure 10:
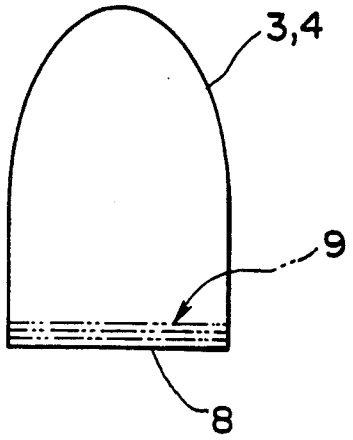
FIG. 10 is an enlarged view of one of a pair of bags in a third embodiment of the present invention.
Figure 11:
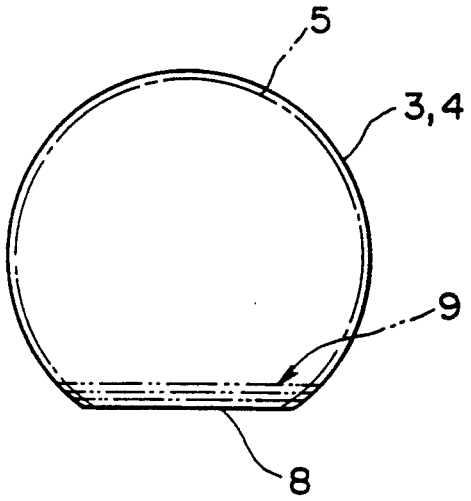
FIG. 11 is a cross sectional view of a bag portion stuffed with circular stuffing.

FIGS. 10 and 11 illustrate a third embodiment of the present invention in which FIG. 10 shows an enlarged view of a bag 3 or 4, and FIG. 11 shows the bag 3 or 4 stuffed with a circular stuffing.

In this embodiment, it is suitable to form an ear having a wider width at an extreme end portion than a width of a base portion. The bag 3 or 4 is knitted to have a width which is gradually narrowed with a small amount towards a midway point or farther of the whole length of the bag 3 or 4 from the base portion at which the bag 3 or 4 is connected to the sock main body 2, and the width of the bag 3 or 4 is narrowed towards the tip end of the bag 3 or 4 with a larger degree of reduction of the width so that a radius of curvature of an edge is sequentially reduced.

A rubber string 9 is provided at an opening portion 8 of the bag 3 or 4 which is in communication with the inside of the sock main body 2 so that the diameter of the opening portion 8 is constricted.

As will be seen from FIG. 11, when circular stuffing is stuffed into the inside of the bag 3 or 4, although the bag is expanded to a circular shape, the opening portion 8 of the bag 3 or 4 is prevented from expanding by an elastic force of the rubber string 9. As a result, a finer circular ear can be made.

Furthermore, when the rubber string 9 prevents the opening portion 8 from expanding, it is possible to prevent the stuffing from falling off the bag 3 or 4.

As described in the foregoing, in the present invention, the following advantages are provided.

Since a pair of bags 3 and 4 are knitted integrally with a sock main body 2 of each of socks so that the bags 3 and 4 are aligned traversely on an upper portion of the sock main body 2 and the inside of the bags 3 and 4 is in communication with the inside of the sock main body 2, ears of various shapes can be formed by the bags 3 and 4. Furthermore, since the ears formed by the pair of bags 3 and 4 are three-dimensional as compared with ears formed by applique or the like, and since the bags move as if the ears swing as a person wearing the socks walks, the interest is increased.

Furthermore, ears of various shapes can be made easily, and also circular ears having a wider width at the end portion than that of the base portion can be formed finely.

What is claimed is:

1. A pair of socks, each of the socks comprising:

a sock main body for covering a foot;

a pair of bags knitted integrally with and continuously to the sock main body of each of the socks, the bags being aligned traversely on an upper portion of the sock main body and extending upright from respective opening portions located at base portions of the bags, an inside of the bags being in communication with an inside of the sock main body at the respective opening portions of the bags;

stuffing simulating the shape of the ears of an animal inserted into the inside of the bags; and means for constricting a diameter of the opening portions of the bags after the stuffing have been inserted into the inside of the bags to prevent the stuffing from falling out of the bags, wherein the bags, when filled with the stuffing and the opening portions thereof are constricted, form the simulated ears of an animal.

2. The pair of socks according to claim 1 wherein the constricting means comprises a string disposed around the opening portion of each of the pair of bags to constrict the diameter of the opening portion.

3. The pair of socks of claim 1 wherein the constricting means comprises:

the opening portion of the bags having a smaller diameter than the adjacent portion of the bags.

4. The pair of socks of claim 2 wherein the string is a rubber string.

* * * * *

UNITED STATES PATENT AND TRADEMARK OFFICE

CERTIFICATE OF CORRECTION

PATENT NO. : 5,325,545

DATED : July 5, 1994

INVENTOR(S) : Takahiro Hirano

It is certified that error appears in the above-indentified patent and that said Letters Patent is hereby corrected as shown below:

Column 3, line 2, after "the" please insert --bag--.

Column 3, line 5, after "shape of the" please insert --bag--.

Column 4, line 51, after "bags" please insert --3 and 4--.

Signed and Sealed this

Twenty-seventh Day of September, 1994

*Attest:*

*Attesting Officer*

Bruce Lehman

BRUCE LEHMAN

*Commissioner of Patents and Trademarks*